US006181773B1

(12) United States Patent
Lee et al.

(10) Patent No.: US 6,181,773 B1
(45) Date of Patent: Jan. 30, 2001

(54) SINGLE-STROKE RADIATION ANTI-SCATTER DEVICE FOR X-RAY EXPOSURE WINDOW

(75) Inventors: Denny L. Y. Lee, West Chester, PA (US); Kelly P. Golden, Bear, DE (US)

(73) Assignee: Direct Radiography Corp., Newark, DE (US)

( * ) Notice: Under 35 U.S.C. 154(b), the term of this patent shall be extended for 0 days.

(21) Appl. No.: 09/264,648

(22) Filed: Mar. 8, 1999

(51) Int. Cl.[7] ..... G21K 1/10
(52) U.S. Cl. ..... 378/155; 378/154
(58) Field of Search ..... 378/154, 155

(56) References Cited

U.S. PATENT DOCUMENTS

| | | | | |
|---|---|---|---|---|
| 1,164,987 | | 12/1915 | Bucky | 378/154 |
| 2,486,089 | | 10/1949 | Zavales | 378/155 |
| 2,685,037 | | 7/1954 | Kuhn et al. | 378/155 |
| 3,660,660 | * | 5/1972 | Pearson et al. | 378/155 |
| 4,646,340 | | 2/1987 | Bauer | 378/155 |
| 4,760,589 | * | 7/1988 | Siczek | 378/155 |
| 4,803,716 | | 2/1989 | Ammann et al. | 378/155 |
| 4,827,495 | * | 5/1989 | Siczek | 378/155 |
| 4,970,398 | * | 11/1990 | Scheid | 250/374 |
| 5,040,202 | * | 8/1991 | Scheid | 378/155 |
| 5,212,719 | | 5/1993 | Virta et al. | 378/155 |
| 5,305,369 | * | 4/1994 | Johnson et al. | 378/155 |
| 5,319,206 | * | 6/1994 | Lee et al. | 250/370.09 |
| 5,357,554 | | 10/1994 | Schneiderman et al. | 378/155 |
| 5,379,335 | | 1/1995 | Griesmer et al. | 378/155 |
| 5,545,899 | * | 8/1996 | Tran et al. | 250/370.09 |
| 5,559,851 | | 9/1996 | Schmitt | 378/155 |
| 5,606,589 | | 2/1997 | Pellegrino et al. | 378/154 |
| 5,625,192 | * | 4/1997 | Oda et al. | 250/363.1 |
| 5,666,395 | | 9/1997 | Tsukamoto et al. | 378/98.4 |
| 6,088,427 | * | 7/2000 | Pagano | 378/155 |

OTHER PUBLICATIONS

"The Essential Physics of Medical Imaging" by J.T. Bushberg et al. pp. 159–168, 1994.

* cited by examiner

*Primary Examiner*—David V. Bruce
*Assistant Examiner*—Allen C. Ho
(74) *Attorney, Agent, or Firm*—Ratner & Prestia

(57) ABSTRACT

A radiation anti-scatter device comprising a grid and a grid driver connected to the grid for unidirectionaly moving the grid with a variable grid velocity along a path between a starting and an end position, and a method of providing such grid motion. The variable grid velocity may have a velocity profile $V_1=k_1t$ for a first period and then $V_2=k_2t^{-m}$ for a second period, where $V_1$ and $V_2$ are velocity, $k_1$ and $k_2$ are constants, t is time, and m is an exponent having a value greater than 0. The anti-scatter device may be a component of a direct radiographic diagnostic imaging system which includes an image-producing element having an array of radiation detectors aligned in rows, and where the anti-scatter device is a grid having vanes oriented at an angle to the detector rows. Radiation emission may be synchronized with the grid motion to optimize a radiograph for a particular grid, radiation source, or examination procedure. The apparatus implements a method for reducing Moiré patterns in radiographic detectors having an array of sensors by unidirectionaly moving the grid in a single stroke during the radiation exposure with an asymptotically decreasing speed profile such that grid motion is maintained for a plurality of different radiation exposure times.

17 Claims, 3 Drawing Sheets

SINGLE-STROKE RADIATION ANTI-SCATTER DEVICE FOR X-RAY EXPOSURE WINDOW

TECHNICAL FIELD

This invention relates to radiation anti-scatter grids, and more particularly, to a single stroke, moving radiation anti-scatter grid that is a component in a radiographic diagnostic imaging system, specifically a direct radiographic imaging system.

BACKGROUND OF THE INVENTION

Description of the Art

Direct radiographic imaging using detectors comprising a two dimensional array of tiny sensors to capture a radiation generated image is well known in the art. The radiation is imagewise modulated as it passes through an object having varying radiation absorption areas. Information representing an image is, typically, captured as a charge distribution stored in a plurality of charge storage capacitors in individual sensors arrayed in a two dimensional matrix.

X-ray images are decreased in contrast by X-rays scattered from objects being imaged. Anti-scatter grids have long been used (Gustov Bucky, U.S. Pat. No. 1,164,987 issued 1915) to absorb the scattered X-rays while passing the primary X-rays. A problem with using grid, however, is that whenever the X-ray detector resolution is comparable or higher than the spacing of the grid, an image artifact from the grid may be seen. Bucky recognized this problem which he solved by moving the anti-scatter grid to eliminate grid image artifacts by blurring the image of the anti-scatter grid (but not of the object, of course).

Improvements to the construction of anti-scatter grids have reduced the need to move the grid, thereby simplifying the apparatus and timing between the anti-scatter grid motion and X-ray generator. However, Moiré pattern artifacts can be introduced when image capture is accomplished through the direct radiographic process or when film images are digitized. (The Essential Physics of Medical Imaging, Jerrold T Bushberg, J. Anthony Seibert, Edwin M. Leidholdt, Jr., and John M. Boone. c1994 Williams & Wilkins, Baltimore, pg. 162 ff.).

When the X-ray detector is composed of a two dimensional array of X-ray sensors, which generate a two dimensional array of picture elements, as opposed to film, the beat between the spatial frequency of the sensors and that of the anti-scatter grid gives rise to an interference pattern having a low spatial frequency, i.e. a Moiré pattern.

There are two possible approaches to solving this problem. The first, described in U.S. Pat. No. 5,666,395 to Tsukamoto et al. teaches Moiré pattern prevention with a static linear grid having a grid pitch that is an integer fraction of the sensor pitch.

In the case where the sensors are separated by dead spaces, i.e. interstitial spaces which are insensitive to radiation detection, Tsukamoto teaches to make the grid pitch to correspond to the sensor pitch and to hold in a steady positional relation to the detector such that the grid elements are substantially centered over the interstitial spaces.

A problem with the above proposed solution, which uses a static grid, is that it is often impractical to position and to maintain the anti-scatter grid in a desired fixed position relative to the radiation detector array.

A second approach, originally proposed by Bucky in U.S. Pat. No. 1,164,987 proposes moving the anti-scatter grid during radiation exposure to blur the artifact images generated by the grid.

The use of a moving grid appears a reasonable solution but for one problem. In modem radiographic equipment the exposure time is determined by automated exposure control devices. The total exposure time is, therefore unknown, and as a consequence the bucky must be maintained in motion for an undetermined length of time, at least long enough for the longest anticipated exposure. Using a single stroke unidirectional linear velocity profile is impractical because as the exposure becomes longer the size of the bucky and the length of the bucky path become far too large to be accommodated in a useful package. The solution adopted by the art is to provide an oscillating bucky which can be continuously on for so long as the exposure lasts.

While this is an ingenious solution it also presents certain practical problems, particularly related to the direction change in the bucky movement at the two path ends where the grid movement becomes zero prior to reversing direction. A number of patents have issued describing different arrangements to solve this reversal problem including oscillating the grid with a velocity that increases as the grid approaches the travel limits prior to reversal of the travel direction, or controlling the location of the grid interstitial spaces at the reversal point to avoid creation of artifacts.

With the exception of the solution proposed by Tsukamoto et al., the above methods have been proposed to solve the problem of a film grid combination rather than direct radiographic imaging application and as such are primarily concerned with the elimination of shadow type artifacts rather than the Moiré patterns which are generated when using a direct radiographic detector comprising rows and columns of individual image detecting sensors with an anti-scatter grid. Direct radiography is a relatively new technology and often requires new and different solutions better fitted to the new set of problems associated with it. The art originally started with a grid which was moveable in one direction. When this approach failed, due to innovations in the radiation exposure equipment, the art solved the new problems by inventing the oscillating grid. This solution worked for radiographic film exposure, but does not adequately solve the Moire type problems associated with direct radiography detectors. There is still a need in the art for a single stroke radiation anti-scatter device suitable for a wide range of exposure windows, and tailored to reduce Moiré-pattern artifacts in digital radiograms.

SUMMARY OF THE INVENTION

In accordance with this invention, there is provided a radiation anti-scatter device comprising a grid, and a grid driver connected to the grid for unidirectionaly moving the grid with a variable grid velocity along a path between a starting and an end position.

The variable grid velocity may comprise a velocity profile having a decreasing velocity component. The decreasing velocity profile is typically exponential, preferably with $V=K_2t^{-m}$, where V is velocity, K is a constant, t is time, and m is an exponent having a value greater than 0. The initial grid velocity is obtained by first accelerating the grid to a desired velocity. The sole requirement for the increasing velocity component is that the desired maximum velocity for the grid is attained rapidly, preferably within milliseconds. Preferably, maximum velocity is attained within 1 to 10 milliseconds and with a grid displacement between 0.5 and 3 cm. Constant acceleration is preferred as it is easier to implement. The motion may be imparted to the grid by a variable speed motor, a variable drive coupling, or a combination thereof.

The anti-scatter device may be part of a direct radiographic diagnostic imaging system further comprising a radiation source for emitting a radiation beam and an image-producing detector comprising an array of radiation sensors positioned in the beam path for receiving the radiation. The system also includes a moveable radiation anti-scatter grid between the radiation source and the detector. The grid is moveable across the image detector with a decelerating velocity profile. The imaging system may further comprise a controller adapted to synchronize the radiation emission with the grid motion.

Still according to the present invention, there is provided a method for reducing scattered radiation and eliminating Moiré patterns in a radiographic detector by moving an anti-scatter grid over the detector in a single stroke in one direction with a decelerating velocity profile during a radiographic exposure, the decelerating velocity profile being such that the grid motion continues for the duration of the longest anticipated radiation exposure. The method may further comprise starting the radiation exposure at a position in the grid motion optimized for a particular grid, radiation source, or examination procedure.

DETAILED DESCRIPTION OF INVENTION

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
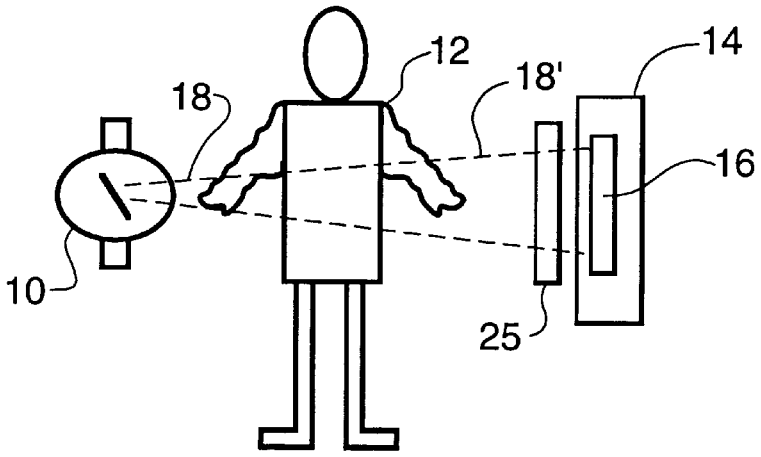
Fig. 1 PRIOR ART
FIG. 1 is a schematic illustration of an exemplary prior art set-up of medical x-ray equipment, showing the relative positioning of a typical anti-scatter grid with respect to a target and a detector.

FIG. 1 shows a schematic arrangement in which a source of X-ray radiation 10 provides a beam 18 of X-rays. A target 12 (i.e. a patient in the case of medical diagnostic imaging) is placed in the X-ray beam path. The radiation emerging through patient 12 is intensity modulated because of the different degrees of X-ray absorption in various parts of the patient's body. Cassette enclosure 14, containing radiation sensor 16, intercepts the modulated X-ray radiation beam 18'. Radiation detector 16 absorbs X-rays that penetrate the cassette enclosure 14, and produces a digital image in accordance with the above-referenced patent.

A radiation anti-scatter device 20, known in the art as a bucky, comprising an anti-scatter grid attached to a holder, is typically placed between target 12 and cassette 14 to focus the modulated X-ray beam to prevent scattered X-rays from impinging the sensor at undesirable angles. Standard bucky grid architecture comprises a set of parallel vanes. The bucky is typically placed so that it moves in a vertical or horizontal plane orthogonal to the length of the vanes.

According to this invention the bucky is moved over the detector in a single stroke during a time period that exceeds the radiation exposure duration. This is obtained by imparting to the moving bucky a decelerating velocity profile preferably one that asymptotically approaches zero.

The velocity profile, by necessity, includes an accelerating first period. The accelerating first period must be such as to accelerate the bucky to its maximum velocity quickly enough so as not to unreasonably delay the onset of the actual patient exposure, and not to use up an excessive fraction of the available grid displacement. Typical acceleration times are of the order of a few milliseconds, preferably between 0.001 and 0.5 seconds. The exact time is determined by practical limitations related to the physical environment of a specific installation and equipment available. In general, it is desirable that the grid move between 0.1 and 1.5 cm during the accelerating period, and that the decelerating portion of the grid movement lasts for about 2 seconds and translates the grid another 1 to 5 cm. The acceleration velocity profile may be linear or non-linear, as desired. A linear profile has the advantage of requiring only a constant force to accelerate the grid.

Figure 2A:
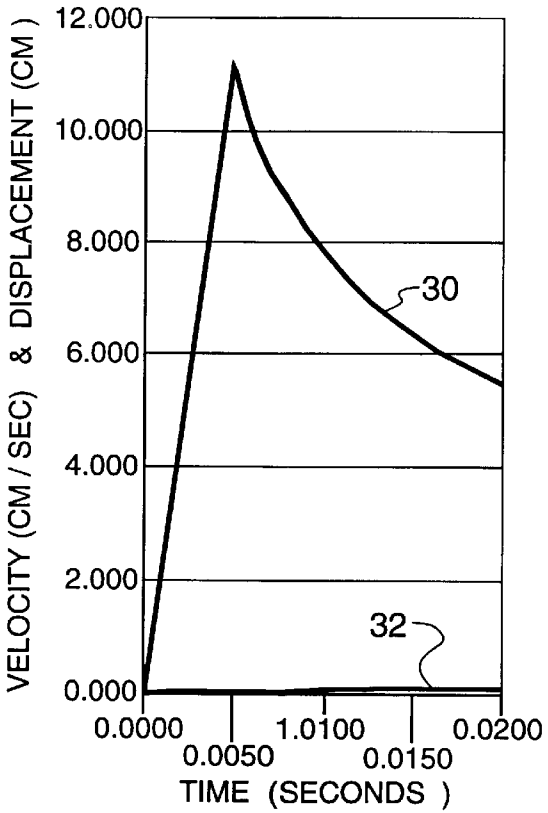
FIGS. 2A, 2B, and 2C depict a graph of an exemplary grid velocity profile according to the present invention over three different time scales.
Figure 2B:
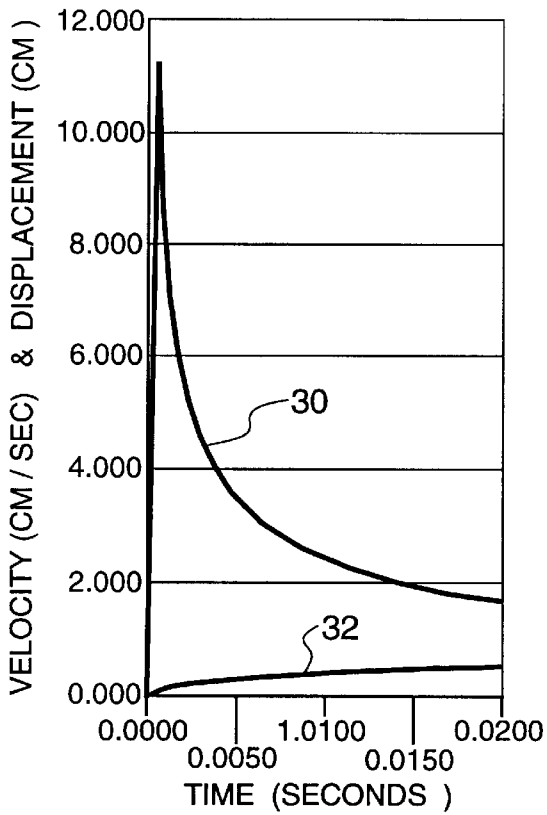
Figure 2C:
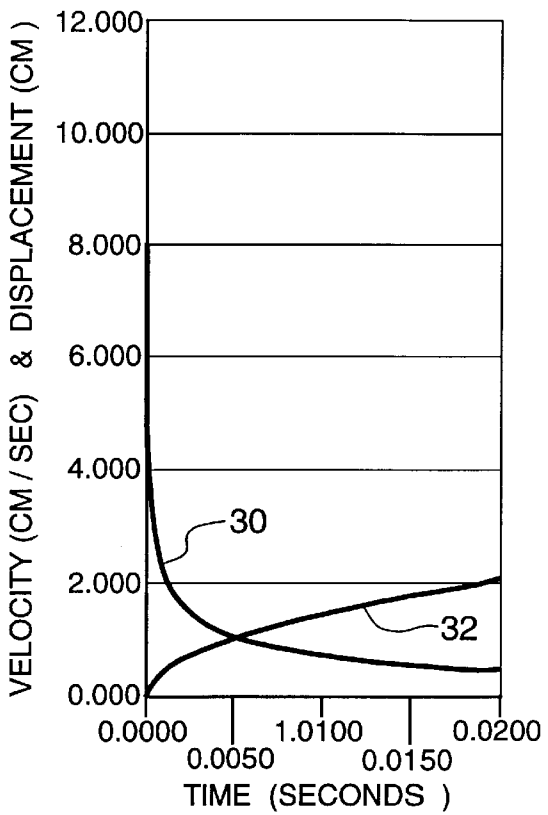

In FIGS. 2A–C, there are shown graphs of time versus velocity graph 30, and time versus displacement graph 32, of an exemplary moving bucky. Each graph depicts the same motion, wherein the time period shown in 2B is 10× that shown in 2A, and 2C is 10× the period in 2B. As illustrated the grid is first accelerated to a first, high velocity, preferably prior to initiating the radiation exposure, and then decelerated again preferably during the exposure. For the first time period, velocity profile 30 conforms to the general equation:

$$V=K_1 t \text{ for } t \text{ equal to or less than } 0.005 \text{ sec.} \quad (1)$$

where:

V=velocity in cm/second

K=2236 and t=time in seconds.

For a second time period, for t greater than 0.005 sec. and less than 2 seconds the velocity profile 30 conforms to the general equation:

$$V=K_2(1000\ t)^{-m} \quad (2)$$

where:

V=velocity in cm/second $K_2$=25, and m=0.5 t=time in seconds.

Figure 3:
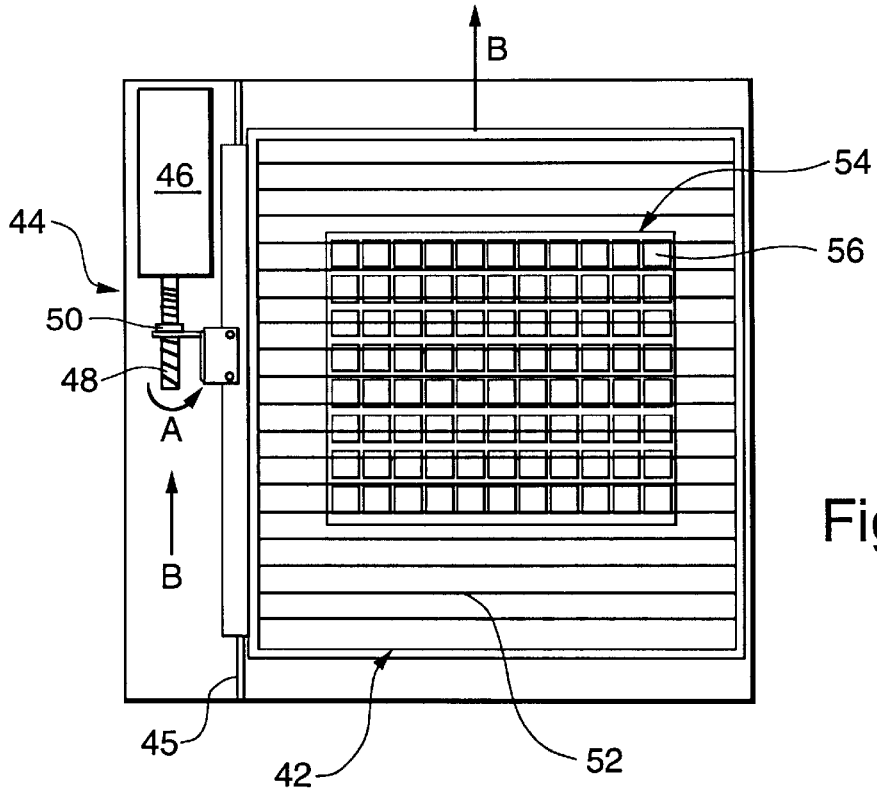
FIG. 3 is a schematic illustration of an exemplary grid and grid drive system of the present invention.

Referring now to FIG. 3, there is shown an exemplary radiation anti-scatter device 40 of the present invention, showing a grid 42 and grid driver mechanism 44 for imparting motion onto the grid. As shown in FIG. 3, grid driver 44 comprises a motor 46, which may be a variable speed DC motor typical of motors well-known in the art, and a variable-pitch screw 48 that is threaded through a "nut" 50 adapted to mesh with the variable pitch of the screw. Thus, as motor 46 turns screw 48 in the direction of arrow A, nut 50, connected by bracket 51 to grid 42, travels in the direction of arrow B and moves the grid along track 45.

Although described as having both a variable speed motor 46 and variable pitch screw 48 with respect to FIG. 3, an alternate grid movement system may comprise a fixed speed motor with a variable pitch screw or any mechanical variable drive coupling known in the art, such as for example, lever/cam or wheel/crank systems. Furthermore, the grid movement system may comprise a variable speed motor with a fixed mechanical coupling. A variable drive coupling and variable speed motor are preferred, however, to promote a operator-changeable accelerating or decelerating velocity profile.

Usually, the radiation blocking elements 52 in the grid are parallel to each other and the grid is oriented so that the blocking elements are also parallel to the alignment of sensors 56 of the detector 54, in one direction (i.e. row or column). The motion of the grid is, usually, perpendicular to the grid radiation blocking elements (also known as vanes). Because the grid is moving relative to the detector, any Moiré patterns created are transient in nature lasting only a few milliseconds, not long enough to be captured by the detector.

Figure 4:
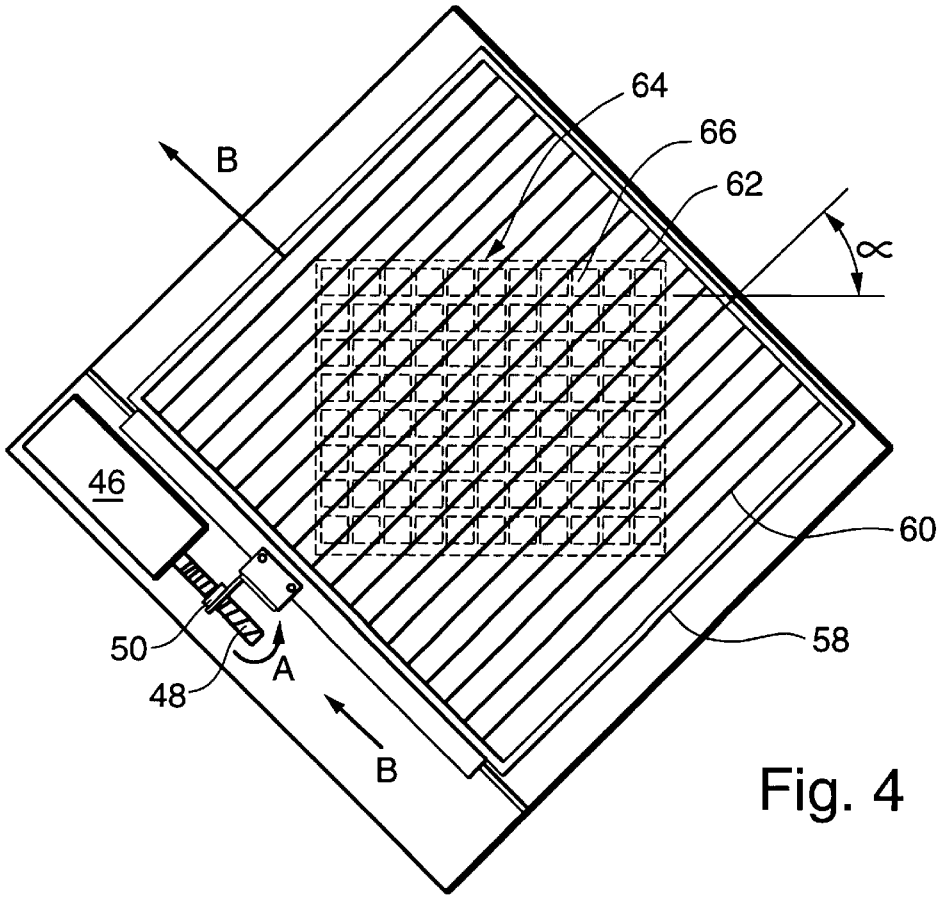
FIG. 4 is another schematic illustration of an exemplary grid and grid drive system of the present invention wherein the grid vanes are at an angle to the detector rows and columns.

An alternate arrangement is shown in FIG. 4. Grid 58 again comprises a plurality of vanes 60 and the motion of the bucky is along arrow B, perpendicular to the orientation of the vanes. The underlying direct radiography panel 62 comprises a plurality of sensors 66 aligned along a first direction (here in rows 64 of sensors 66). The angle a between vanes 60 and rows 64 of sensors 66 is approximately 45 degrees, as shown in FIG. 3. Thus, the angle (90-$\alpha$) between the motion along arrow B and the orientation of the rows of pixels is also approximately 45 degrees. Although an approximate 45-degree orientation is shown herein, angle a may be any non-parallel or non-orthogonal angle that minimizes Moiré pattern artifacts in a radiograph produced by the imaging system of which the bucky is a component.

Figure 5:
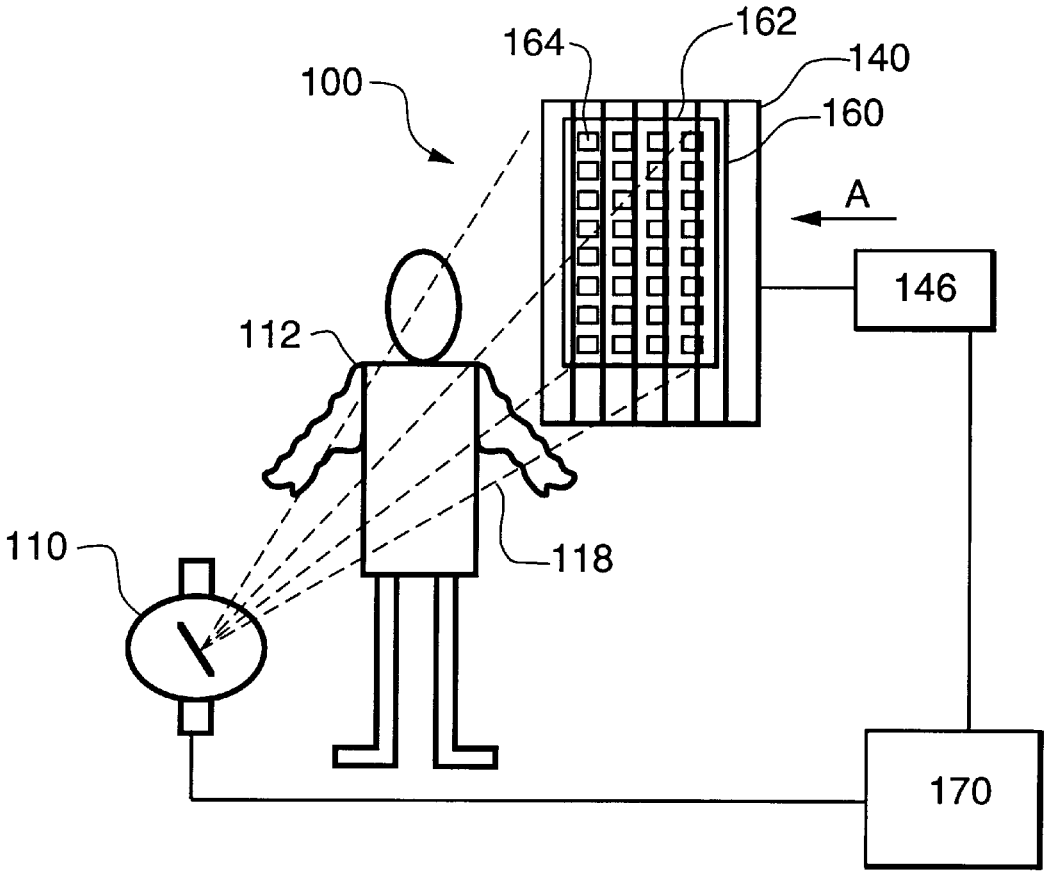
FIG. 5 is a schematic illustration of an exemplary direct radiographic diagnostic imaging system of the present invention.

Referring now to FIG. 5, the invention comprises a radiographic diagnostic imaging system 100 which includes a source 110 of penetrative radiation for emitting a radiation beam 118 along a path through a target 112. The radiation source is captured by a detector 162 positioned in the beam path for receiving the radiation; Detector 162 is a direct radiographic detector comprising a plurality of radiation sensors 164 arrayed in rows and columns of the type described in U.S. Pat. No. 5,319,206 issued to Lee et al. on Jun. 7, 1997. According to the present invention, there is placed in front of the detector 162, between the detector and the target 112, an anti-scatter grid 140 having a plurality of radiation absorbing elements, vanes 160. In the illustration the vanes 160 are oriented parallel to the detector's columns of sensors. However this is not critical, and the vanes can be oriented at an angle to the detector rows and columns, as illustrated in FIG. 3.

The anti-scatter grid is mounted so as to be moveable relative to the detector and radiation beam through a supporting and moving mechanism represented by block 146. The drive shown is given by way of illustration rather than limiting the way in which the variable speed profile is achieved. A any other mechanical or electromechanical arrangement that will provide the necessary motion to the antiscatter grid, that is will accelerate and decelerate the grid at the required rates, preferably in accordance with the equations given earlier in this description, may be used.

The motion imparted by the mechanism is in the direction of the arrow "A" and is preferably in a direction perpendicular to the vanes 160.

The system further comprises a controller 170 adapted to synchronize the radiation exposure to the motion of the grid. Controller 170, which may be a computer, is used to begin the radiation emission from source 110 when the grid velocity is at a desired point, preferably right after it has reached its maximum and the deceleration cycle has just begun.

The invention also comprises a method whereby grid generated artifacts are reduced by moving the anti-scatter grid unidirectionally during the full radiation exposure using a continuously decreasing rate of movement of the grid. This is done by imparting a single stroke motion to the grid whereby the grid is first accelerated to a first maximum velocity and then decelerated with a decelerating velocity profile, preferably one which approaches zero asymptotically. For example, the decelerating velocity profile may comprise $V=K_2t^{-m}$. The accelerating speed profile is not important so long as it can produce the desired velocity within a short time, of the order of a few milliseconds. The accelerating profile may be a linear function such as $V=K_1t$ The variables are as described above, and more preferably V(cm/sec)=2,236 t(sec) for t less than or equal to 0.005 seconds and $V=25*(t*1,000)^{-0.5}$ for t greater than 0.005 seconds and less than or equal to 2 seconds where V is in cm/sec and t is in seconds.

The method steps include moving the grid in a direction perpendicular to its vanes with the grid oriented so that it traverses the detector in a direction perpendicular to the detector rows or columns of sensors when the grid vanes are aligned with either the rows or columns of the detector. Alternatively, the grid may be moved in a direction that is at an acute angle to its vanes. In still an alternate embodiment the motion of the grid may be perpendicular to its vanes but with the grid vanes forming an acute angle with the rows or columns of the detector. This angle is preferably selected to be 45°. The advantage of the last two alternatives is that the dead spaces between detector columns (or rows) never align with the grid vanes therefore further reducing the Moiré pattern formation as the grid travels over the detector. The disadvantage is that it is more complicated to implement this type of oblique translation of the grid in existing equipment, and may require a larger grid.

In practicing the present method, the beginning of the x-ray exposure is timed to assure that the grid is moving at a sufficient velocity during the exposure. Such timing may comprise an initial delay to allow the grid to reach a predetermined speed, it may comprise a chosen start time to produce a desired average velocity, or it may preferably comprise a chosen start time so that the x-ray generator radiation emission pulses begin at maximum velocity (point 34 on FIG. 2) just as the grid begins decelerating. The method of controlling the grid may comprise starting the radiation exposure at any position in the grid motion optimized for a particular grid, radiation source, or examination procedure.

Those skilled in the art having the benefit of the teachings of the present invention as hereinabove set forth, can effect numerous modifications thereto. These modifications are to be construed as being encompassed within the scope of the present invention as set forth in the appended claims wherein

We claim:

1. A radiation anti-scatter device comprising:

a grid having a plurality of radiation absorbing elements, a grid path comprising a start grid position at a first end of said path and a finish grid position at a second end of said path; and a grid driver connected to said grid for moving said grid during an operating cycle from said start position to said finish grid position in a single unidirectional stroke at a variable speed along said path.

2. The radiation anti-scatter device according to claim 1, wherein said variable speed comprises a velocity profile having a decreasing velocity component.

3. The radiation anti-scatter device according to claim 2, wherein said velocity profile also comprises an increasing velocity component.

4. The radiation anti-scatter device according to claim 2 wherein the velocity profile comprises $V=K_2t^{-m}$, where V is the grid velocity, $K_2$ is a constant, t is time and m is an exponent having a value greater than 0.

5. A radiation anti-scatter device comprising:

a grid having a plurality of radiation absorbing elements, and a grid driver connected to said grid for moving said grid in a single unidirectional stroke at a variable speed between a starting and an end position, wherein said variable speed comprises a velocity profile and wherein the velocity profile comprises a first velocity component $V_1=K_1t$ for a first period and a second velocity component $V_2=K_2t^{-m}$ for a second period, where $K_1$ and $K_2$ are constants and m is greater than zero and equal to or less than one.

6. A direct radiographic diagnostic imaging system comprising:

a source of penetrative radiation for emitting on command a radiation beam along a path;

a radiation detector positioned in the beam path for receiving said radiation, said detector comprising an array of radiation sensors aligned in a first direction; and a movable radiation anti-scatter grid assembly positioned between said radiation source and said detector, said grid assembly comprising:

a grid having a plurality of radiation absorbing elements oriented in a second direction at an angle to said first direction, and a grid driver adapted to traverse said grid in a single stroke across the detector with a variable speed profile.

7. The system of claim 6 wherein said angle is 90 degrees.

8. The system of claim 7 wherein said grid traverses said detector in the first direction.

9. The system of claim 6 wherein said angle is an acute angle.

10. The system of claim 9 wherein said grid traverses said detector in a direction substantially perpendicular to said second direction.

11. The system of claim 6 wherein said velocity profile comprises $V_1=K_1t$ for a first period and then $V_2=K_2t^{-m}$ for a second period, where $V_1$ and $V_2$ are velocity, $K_1$ and $K_2$ are constants, t is time, and m is an exponent having a value greater than 0.

12. The system of claim 8 further comprising a controller adapted to synchronize emission of said radiation beam with movement of said grid.

13. A method for reducing Moiré patterns in a radiation detection system comprising a detector having an array of discreet sensors aligned along a first direction, a radiation exposure source, and an anti-scatter grid assembly located between said detector and said source, said method comprising traversing said grid across said detector once in a single unidirectional stroke with a variable velocity profile.

14. The method according to claim 13 wherein said velocity profile decreases asymptotically to zero.

15. A method for reducing Moiré patterns in a radiation detection system comprising a detector having an array of discreet sensors aligned along a first direction, a radiation exposure source, and an anti-scatter grid assembly located between said detector and said source, said method comprising traversing said grid across said detector once in a single unidirectional stroke wherein the step of traversing said grid comprises:

A. first accelerating said grid to a first velocity;

B. beginning asymptotically decelerating said grid from said first velocity toward a final velocity; and C. causing said radiation exposure source to emit radiation only after the onset of step "B".

16. The method according to claim 15 wherein said accelerating step comprises accelerating the grid at a velocity profile $V_1=K_1t$ decelerating the grid at a velocity profile $V_2=K_2t^{-m}$, where $K_1$ and $K_2$ are constants and m is greater than zero.

17. The method according to claim 16 wherein the accelerating step has a duration $t_1$ of between about 0.001 and 0.5 seconds and the decelerating step has a duration $t_2$ less than or equal to 2 seconds.

* * * * *